United States Patent [19]

Sutherland

[11] 4,306,715

[45] Dec. 22, 1981

[54] BARBELL STORAGE AND EXERCISE RACK

[76] Inventor: James W. Sutherland, 2257 Heath Rd., Hastings, Mich. 49058

[21] Appl. No.: 127,828

[22] Filed: Mar. 6, 1980

[51] Int. Cl.[3] ..... A63B 13/00

[52] U.S. Cl. ..... 272/117

[58] Field of Search ..... 272/62, 63, 93, 113, 272/116–123, 134, 144; 5/149, 150 B, 174, 175, 181, 201–203; 182/178, 179; 297/5; 248/127

[56] References Cited

U.S. PATENT DOCUMENTS

| | | | |
|---|---|---|---|
| 2,932,509 | 4/1960 | Zinkin | 272/117 |
| 2,960,701 | 11/1960 | Nawara | 272/144 X |
| 3,118,668 | 1/1964 | Callahan | 272/122 |
| 3,273,888 | 9/1966 | Burns | 297/5 X |
| 3,850,264 | 11/1974 | Salinas | 182/179 X |
| 3,948,513 | 4/1976 | Pfotenhauer | 272/122 X |
| 4,153,244 | 5/1979 | Tauber | 272/62 X |

OTHER PUBLICATIONS

"Marcy Gym Equipment", Oct. 1969, pp. 10, 11, 14, 29.

*Primary Examiner*—Richard J. Apley

*Attorney, Agent, or Firm*—Price, Heneveld, Huizenga & Cooper

[57] ABSTRACT

A barbell storage and exercise rack is particularly designed for squatting exercises, and includes a pair of cradles in which the barbell is laterally received and supported in a stored position. The cradles are vertically adjustable to a height which permits the user to easily remove and replace the barbell from a standing position. The barbell rack further includes a pair of safety side rails which are spaced apart a distance sufficient to permit the user to stand between the rails and perform squatting and other weight lifting exercises. The safety side rails are vertically adjustable to an elevation disposed slightly below the lowest position assumed by the barbell during the exercise, such as the squat position, so as to prevent the barbell from inadvertently falling on the user should the weight slip or overcome him.

8 Claims, 7 Drawing Figures

1
2
3
4
6
7
9
10
11
15
16
17
21
22
23
24
25
26
27
28
31
40

2
9
34
35
36
37
38
39
40
VI 2
3
4
9
10
11
15
16
17
23
24
25
26
27
31
38
39
40
44
45
V 4
9
11
22
24
28
29
31
32
VI 2
4
9
10
16
17
25
26
27
31
VII 2
9
11
22
28
29
31
32

24
25
26
27

BARBELL STORAGE AND EXERCISE RACK

BACKGROUND OF THE INVENTION

The present invention relates to barbell exercising devices, and in particular to a barbell storage and exercise rack which is particularly adapted for squatting exercises.

Squatting exercises are performed to build up leg muscles and total body strength, and are one of the basic exercises performed by weight lifters, athletes, and other physical fitness enthusiasts. This exercise is usually performed by supporting a barbell on the user's shoulders or above his head, and then stooping from a standing position to a squatting position. If, during the exercise, the user is unable to rise from the squatting position because of fatique or other reasons, the weight of the barbell can cause the lifter to collapse on the floor, and thereby inflict physical injury to the lifter and/or damage the exercise equipment. For this reason, human spotters are often deployed on opposite sides of the lifter to assist him should help be required. Although some exercise racks for barbells have been developed, they do not permit the user to exercise free of obstruction, and are not adapted for squatting exercises.

Another problem encountered with barbell exercise equipment is that it is not easily portable. Because such equipment must be quite sturdy and durable to support heavy weights and high forces, it is usually very heavy, and must be fixed to the floor or walls of the room. Hence, present exercise equipment is not very maneuverable, and is therefore not well suited for residential or non-institutional uses.

SUMMARY OF THE INVENTION

The present invention provides a barbell storage and exercise rack comprising a pair of upstanding supports spaced laterally apart, with upper portions thereof shaped for abuttingly supporting thereon opposing ends of a barbell in a stored position. The supports include means for varying the elevation of the barbell to a convenient storage height for a selected exercise. A pair of safety side rails have one end thereof disposed adjacent to the supports, and are oriented substantially perpendicular to the direction of the barbell in the stored position. The side rails are parallel, spaced laterally apart a distance sufficient to permit a weight lifter to position himself therebetween, and are adapted to abuttingly support the barbell thereon. Means are provided for supporting the side rails and adjusting the height of the same to an elevation slightly below the lowest normal barbell elevation for the selected exercise, so as to prevent the barbell from inadvertently falling on the weight lifter.

Another aspect of the present invention provides a barbell exercise rack with safety side rails supported by left and right hand frame members at a selected elevation. A cross brace extends between and is connected with the safety side rails adjacent one end thereof to interconnect the left and right hand sides of the rack to form a freestanding structure, wherein the other end of the side rails is open to permit the weight lifter to freely walk between the rails, access the barbell, and safely exercise between the side rails without obstruction. The weight lifter can exercise to a point of full exertion without fear of being hurt by the barbell should the weight overcome him, and without requiring human spotters.

The principal objects of the present invention are: to provide a barbell rack in which a user may safely exercise; to provide a barbell rack which is particularly adapted for squatting exercises; to provide a barbell rack which can be adjusted to facilitate a wide variety of differently sized users; to provide a barbell rack having vertically adjustable cradles for securely storing the barbell at a convenient height; to provide a barbell rack having an open end to freely access the barbell and exercise therein without obstruction; to provide a barbell rack in which the user can safely perform officially sanctioned squatting exercises without interference or human spotters; to provide such a barbell rack with laterally adjustable left and right hand side members to accommodate various users; to provide a barbell rack which is freestanding and self-supporting; to provide a barbell rack which can be disassembled and easily transported; to provide a barbell rack which is lightweight, strong and durable; to provide a barbell rack having an uncomplicated design for ease of assembly and disassembly; and to provide a barbell rack which is economical to manufacture, efficient in use, capable of a long operating life, and particularly well adapted for the proposed use.

These and many other important features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
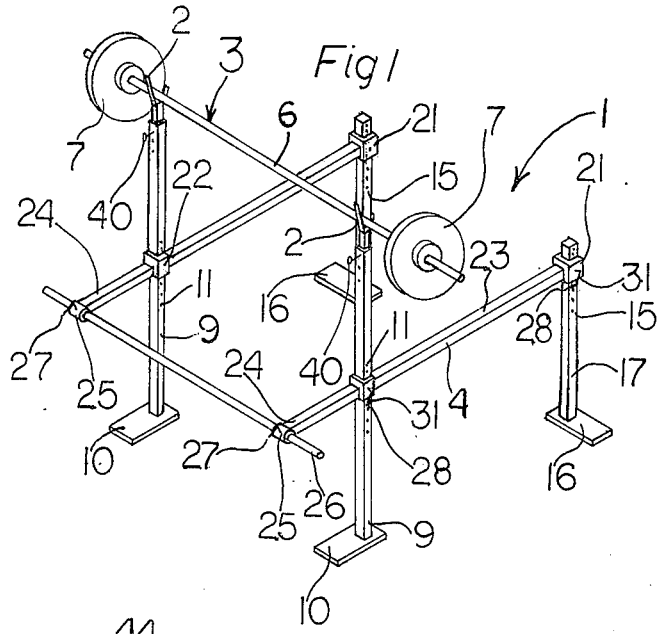
FIG. 1 is a perspective view of a barbell storage and exercise rack embodying the present invention, shown with a barbell positioned therein.
Figure 2:
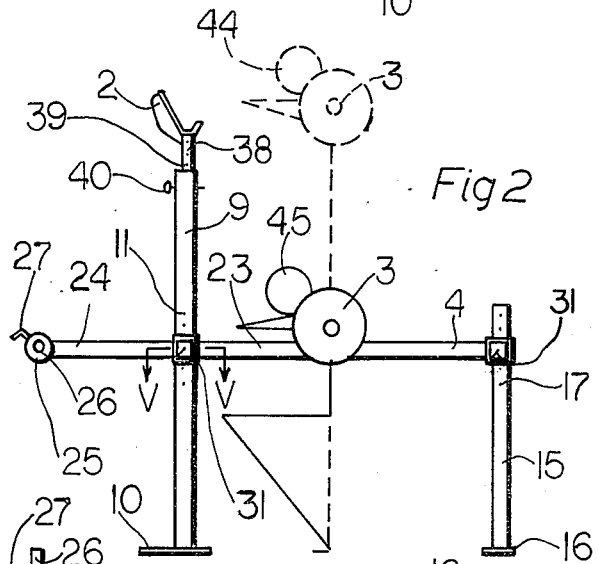
FIG. 2 is a side elevational view of the barbell rack, shown with a weight lifter performing a squatting exercise therein.

For purposes of description herein, the terms "upper", "lower", "right", "left", "rear", "front", "vertical", "horizontal", and derivatives thereof shall relate to the invention as oriented in FIGS. 1 and 2. However, it is to be understood that the invention may assume various alternative orientations, except where expressly specified to the contrary.

The reference numeral 1 (FIG. 1) generally designates a barbell storage and exercise rack embodying the present invention. Rack 1 includes a pair of cradles 2 in which a barbell 3 is laterally received and supported in a stored position. Cradles 2 are vertically adjustable to a height which permits the user to easily remove and replace barbell 2 from a standing position, as best illustrated in FIG. 2. Rack 1 further includes a pair of safety side rails 4 which are spaced apart a distance sufficient to permit the user to stand between the rails and perform exercises. Side rails 4 are vertically adjustable to an elevation slightly below the lower position of the barbell during the exercise, so as to prevent the barbell from falling on the user.

The rack 1 is particularly designed for squatting exercises, as illustrated in FIG. 2. However, it is to be understood that the rack may be used in conjunction with a wide variety of exercises, such as curling, and the like, wherein the barbell is manipulated at an elevation above the floor, and there is some danger that the inadvertent release of the barbell, such as when the user's hands slip, and/or the user is overcome by the weight of the barbell, will cause injury to the user and/or damage his equipment.

Figure 6:
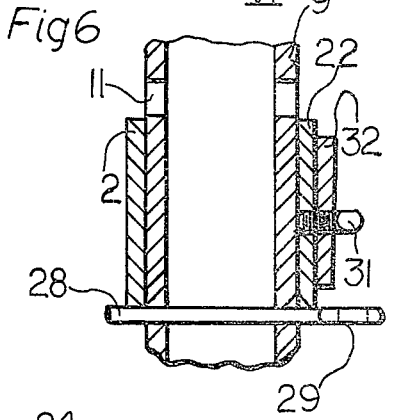
FIG. 6 is a cross-sectional view of the lock, taken along the line VI—VI, FIG. 5.
Figure 7:
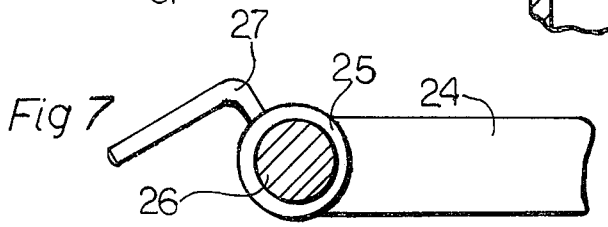
FIG. 7 is an enlarged, fragmentary cross-sectional view of the barbell rack, taken along the line VII—VII, FIG. 3.

As best illustrated in FIG. 1, rack 1 includes a pair of upstanding, vertical supports 9 located at the forward end of the rack (as weight lifter 45 faces in FIG. 2). Supports 9 have plate shaped feet 10 connected with the lower end thereof to abuttingly support the device on a planar surface. The illustrated feet 10 are elongate and oriented parallel with the longitudinal axis of the rack, with the largest portion of the foot directed rearwardly for additional stability and to avoid interference with the user's exercises. The forward supports 9 have a height which is preferably slightly smaller than the height of the average user, in the nature of 5 to 6 feet. In this example, the vertical supports 9 are constructed of a tubular material with a square, transverse cross-sectional shape. A series of vertically spaced apertures 11 are positioned through the medial portion of each of the vertical supports 9 to attach the side rails 4 thereto in a manner to be described in greater detail hereinafter. As best shown in FIG. 6, apertures 11 preferably extend through both side walls of the tube on the laterally facing, opposed surfaces.

Figure 4:
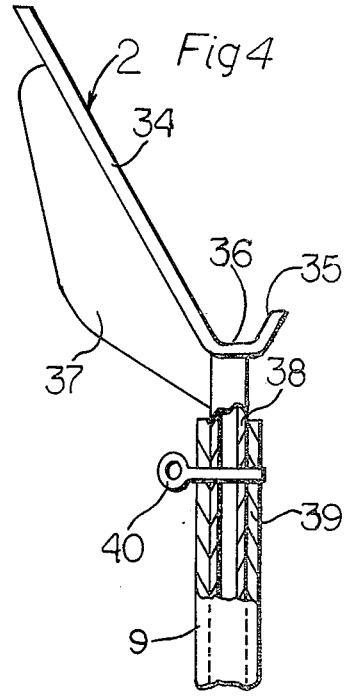
FIG. 4 is an enlarged, side elevational view of a cradle portion of the rack, with portions thereof broken away to reveal internal construction.

The cradles 2 (FIG. 4) are mounted in the upper ends of forward supports 9, and include inclined forward and rear flanges 34 and 35 respectively, and an integrally formed base 36 which is adapted to receive and abuttingly support thereon the bar portion 6 of barbell 3. The forward flange 34 is enlarged and faces toward the front of rack 1, and a reinforcing gusset 37 interconnects the same with a depending post 38 which is received telescopically in the upper end of the support 9. The illustrated post 9 has a square lateral cross-sectional shape which mates with the rear support 9, and prevents rotation therebetween. Post 38 includes a plurality of vertically spaced apart apertures 39 oriented parallel with the longitudinal axis of the rack. A laterally extending pin 40 is provided at the upper end of each rear support 9, and selectively interconnects cradle post 38 with the support, such that the elevation of the cradles can be independently adjusted. Pin 40 has a ring shaped end to facilitate grasping.

Another pair of upstanding, vertical support columns 15 are located at the rearward end of rack 1, and support the other end of the safety side rails 4. Rearward support columns 15 are similar in construction to forward supports 9, and include plate shaped feet 16, and are preferably constructed of a tubular material having a square, cross-sectional shape. Feet 16 are also elongate, but are oriented laterally to provide extra stability without interfering with the user's movement. Rear supports 15 are shorter than forward supports 9, and have a preferred height in the range of 2–4 feet. Vertically spaced apertures 17 are provided in the upper end of each rear support column 15. The apertures 17 extend through both side walls of the forward support 15 on the opposing, laterally oriented faces of the support. Apertures 17 are located at elevations which correspond to the forward support apertures 11, such that when assembled, side rails 4 generally assume a substantially horizontal orientation.

The side rails 4 (FIGS. 1 and 2) are also preferably constructed of a tubular material having a square transverse cross-sectional shape, and include rearward and forward sleeves 21 and 22 which are vertically oriented, and are telescopically received over the rearward and forward support columns 15 and 9 respectively. Sleeve 22 divides the side rails into a medial portion 23 extending between the vertical supports 9 and 15, and an end portion 24 which extends rearwardly of the supports 9. The rail end portions 24 include laterally oriented sleeves 25 thereon in which a rod or cylindrically shaped cross brace 26 is received. As best illustrated in FIG. 6, each sleeve 25 includes an L-shaped set screw 27 which detachably engages cross brace 26 and locks the same in place so as to securely interconnect the left and right hand portions of rack 1. The lateral distance between the left and right hand frames may be easily varied by loosening one or both set screws 27 and converging or diverging the frame halves in accordance with the desired configuration.

Figure 5:
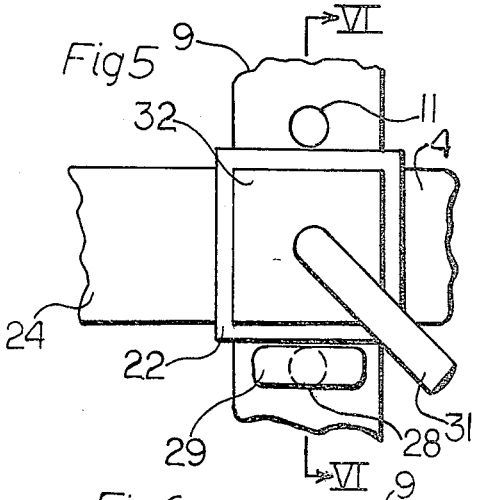
FIG. 5 is an enlarged fragmentary side elevational view of a lock portion of the barbell rack.
Figure 3:
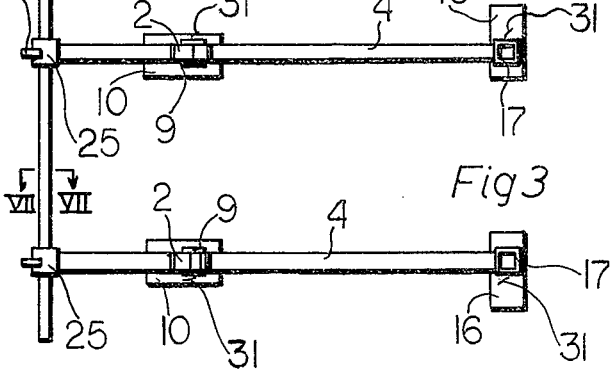
FIG. 3 is a top plan view of the barbell rack.

Sleeves 21 and 22 are each provided with a lock mechanism for selectively and positively locking the side rails 4 in place on the vertical supports 9 and 15. Sleeves 21 and 22 are abuttingly supported on pins 28 (FIGS. 5 and 6) which are shaped for telescopic insertion through vertical support apertures 11 and 17, and extend therethrough on both sides of the support. The illustrated pins 28 include ring shaped ends 29 for grasping to facilitate inserting and withdrawing the pins from supports 9 and 15. In addition to pins 28, a set screw 31 is threadedly mounted on a plate 32 which is affixed to the exterior side of each of the sleeves 21 and 22. The set screws 31 are L-shaped with a handle portion to facilitate rotating the same, and are positioned to engage the supports between adjacent apertures 11 and 17. To lock the sleeves on the associated support, the set screws are screwed inwardly until the terminal end of the screw abuts and engages the support, thereby securely locking the sleeve in place.

In use, rack 1 is assembled in the manner illustrated in FIG. 1 to perform squatting exercises. The lateral distance between safety side rails 4 is adjusted in accordance with the size of the user and the length of the barbell 3. After the lateral adjustment has been made, set screws 27 are tightened to securely interlock the left and right hand side frames of rack 1, thereby forming a freestanding, self-supporting structure, which need not be anchored to the floor to achieve stability. The vertical position of the barbell 3 is then adjusted by telescopically sliding the cradles 2 in the upper end of vertical supports 9, and inserting pins 40 through the selected pair of apertures 39 to positively retain the cradles in place. As best illustrated in FIG. 2, the cradles are preferably adjusted to an elevation which is convenient for the user to remove and replace the barbell from the cradles from a standing position. The structure illustrated in FIG. 2 has the cradles adjusted to an elevation slightly below the height which the barbell bar assumes when it is raised onto the shoulders of the user, as illustrated by the stick figure 44 in phantom lines. In this manner, the barbell may be removed from the cradles by having the lifter position his shoulders directly underneath the bar, and then rise slightly, such that the bar portion 6 of the barbell clears the forward cradle flange 35. When the user is finished exercising, the barbell may be easily replaced in the cradles by having the lifter reverse this procedure, in a manner wherein he stoops slightly in position between the cradles.

The elevation of the safety side rails 4 is then adjusted to a height slightly below the lowest normal barbell elevation for the selected exercise. As illustrated in FIG. 2, for squatting exercises, the lowest normal barbell position will be in the squatting position, as indicated by the stick figure noted by the reference numeral 45. The safety rails should then be located approximately one aperture below this level, such that the safety side rails will not abut or otherwise interfere with the barbell 3, but will catch and support the barbell should the barbell collapse the lifter or otherwise slip from the user's grasp. Pins 28 are inserted through the above selected apertures 11 and 17, and the rails are abuttingly supported thereon in a substantially horizontal position. Set screws 31 are then tightened to securely lock the rails on the supports 9 and 15. The upper ends of the vertical supports 9 and 15 form stops which will prevent the barbell from rolling off of the rails.

After the rack has been properly adjusted for the desired exercise, the user walks through the open, rearward end of the rack, between vertical supports 15, and addresses the barbell. Preferably, the weight lifter approaches the bar facing forward, ducks under the bar 6, and positions himself beneath the barbell for unracking. The user then removes barbell 3 from cradles 2 in a manner previously described, or by using another similar technique known in the weight lifting art. The user then stops backward to the center of the rack where he can safely exercise without obstruction.

The rack 1 has an open end, with parallel sides which are spaced apart in a manner which permits the user to easily access the barbell, and to safely exercise between the side rails to a point of full exertion. The storage cradles 2 and the safety side rails 4 can both be independently adjusted to accommodate a wide variety of different size users. Further, the rack is freestanding, and may be easily disassembled for transportation and/or storage.

In the foregoing description, it will be readily appreciated by those skilled in the art that many modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. A barbell exercise rack, comprising:

a pair of upstanding supports spaced laterally apart;

each pair of upstanding supports including two, vertically disposed, and longitudinally spaced apart legs, positioned in parallel planes on the left and right hand sides of said rack; each of said legs including a foot shaped for abutting support on the base surface without anchors interconnecting the same, whereby said rack is freestanding and readily transportable over the base surface;

a pair of safety side rails connected with and supported by said upstanding supports; said side rails being substantially parallel, adapted for abuttingly supporting thereon a barbell extending laterally across said side rails, and spaced laterally apart a distance sufficient to permit a weight lifter to be positioned therebetween;

means for adjusting the height of said side rails for positioning the same at an elevation slightly below the lowest normal barbell elevation for a selected exercise, so as to prevent the barbell from inadvertently falling on the weight lifter;

a cross brace extending between the connected with said side rails adjacent one end thereof for interconnecting left and right hand sides of said rack to form a freestanding structure, wherein the other end of said side rails is open thereby permitting the weight lifter to freely ambulate therebetween, access the barbell, and safely exercise between the side rails without obstruction.

2. A barbell exercise rack as set forth in claim 1, including:

means for detachably connecting said cross brace with said side rails for varying the lateral distance between said side rails.

3. A barbell exercise rack as set forth in claim 1 or 2, including:

a barbell storage rack disposed adjacent said side rail one end, and including means for supporting the barbell above said safety side rails in a substantially perpendicular relationship thereto.

4. A barbell exercise rack as set forth in claim 3, including:

means for adjusting the height of said storage rack to vary the elevation of the barbell to a convenient storage height for the selected exercise.

5. A barbell storage and exercise rack, comprising:

first and second upstanding barbell supports having lower ends shaped for abutting support on a base surface, and upper ends with cradle portions adapted to receive and support therein opposing ends of a barbell bar in a stored position; said cradle portions being mounted in said supports for vertical adjustment to vary the elevation of the barbell in the stored position;

first and second safety side rails having first portions thereof adjacent one end of the rails detachably connected with said first and second supports respectively for vertical adjustment therealong; said rails being oriented substantially perpendicular to the direction of the barbell bar in the stored position, and disposed below said cradle portions;

first and second upstanding rail supports having lower ends shaped for abutting support on the base surface, and upper end portions detachably connected with the other end portions of said side rails for vertical adjustment therealong; and a cross brace extending between and connected with said first and second side rails adjacent the one end of the rails, thereby forming a freestanding structure.

6. A barbell storage and exercise rack as set forth in claim 5, wherein:

said side rails include laterally oriented sleeves attached thereto adjacent said one end; said sleeves telescopingly receiving said cross brace therein and including a set screw for selectively locking said side rails in place.

7. A barbell storage and exercise rack as set forth in claim 6, wherein said side rails include:

first vertically oriented sleeves at said first portions shaped for telescopingly receiving said barbell supports therein with means for selectively interlocking the same; and second vertically oriented sleeves at said other rail end shaped for telescopingly receiving said rail supports therein with means for selectively interlocking the same, whereby said rack is completed disassemblable.

8. A barbell storage and exercise rack as set forth in claim 5, 6 or 7, wherein:

said cradle portions are telescopingly mounted in the upper ends of said barbell supports and include means for positively interlocking the same at a plurality of different vertical positions.

* * * * *

UNITED STATES PATENT AND TRADEMARK OFFICE

CERTIFICATE OF CORRECTION

PATENT NO. : 4,306,715

DATED : December 22, 1981

INVENTOR(S) : James W. Sutherland

It is certified that error appears in the above—identified patent and that said Letters Patent is hereby corrected as shown below:

Column 5, line 35, "stops" should be --steps--.

Column 6, Claim 1, line 10, "the" should be --and--.

Column 8, Claim 7, line 1, "completed" should be --completely--.

Signed and Sealed this

*First* Day of *June 1982*

[SEAL]

*Attest:*

GERALD J. MOSSINGHOFF

*Attesting Officer*

*Commissioner of Patents and Trademarks*